US008671608B2

(12) United States Patent
Vesligaj

(10) Patent No.: US 8,671,608 B2
(45) Date of Patent: Mar. 18, 2014

(54) STOCK ASSEMBLY WITH RECOIL SUPPRESSION

(76) Inventor: Zeljko Vesligaj, Burgaw, NC (US)

( * ) Notice: Subject to any disclaimer, the term of this patent is extended or adjusted under 35 U.S.C. 154(b) by 128 days.

(21) Appl. No.: 13/373,056

(22) Filed: Nov. 3, 2011

(65) Prior Publication Data

US 2012/0042556 A1 Feb. 23, 2012

Related U.S. Application Data

(63) Continuation-in-part of application No. 12/455,125, filed on May 28, 2009, now Pat. No. 8,051,593.

(60) Provisional application No. 61/192,840, filed on Sep. 22, 2008, provisional application No. 61/203,894, filed on Dec. 30, 2008.

(51) Int. Cl.
*F41C 23/14* (2006.01)
*F41C 23/06* (2006.01)

(52) U.S. Cl.
CPC ..... *F41C 23/14* (2013.01); *F41C 23/06* (2013.01)
USPC ..... 42/73; 42/75.03; 89/44.01

(58) Field of Classification Search
CPC ..... F41C 23/14; F41C 23/06; F41C 23/08
USPC ..... 89/44.01; 42/75.03, 73, 75.01, 74
See application file for complete search history.

(56) References Cited

U.S. PATENT DOCUMENTS

| | | | | |
|---|---|---|---|---|
| 3,300,889 | A | 1/1967 | Baker | |
| 3,707,797 | A | 1/1973 | Ruth | |
| 3,714,726 | A | 2/1973 | Braun | |
| 3,754,344 | A | 8/1973 | Spiliotis | |
| 4,439,943 | A | 4/1984 | Brakhage | |
| 4,910,904 | A | 3/1990 | Rose | |
| 5,031,348 | A | 7/1991 | Carey | |
| 5,173,564 | A | 12/1992 | Hammond, Jr. | |
| 5,827,992 | A | 10/1998 | Harris et al. | |
| 6,481,143 | B2 | 11/2002 | McCarthy | |
| 6,688,031 | B2 | 2/2004 | Steele | |
| 6,732,466 | B2 | 5/2004 | Bentley | |
| 6,874,267 | B2 | 4/2005 | Fitzpatrick et al. | |
| 7,124,529 | B1 | 10/2006 | Havelka, Jr. | |
| 7,152,355 | B2 | 12/2006 | Fitzpatrick et al. | |
| 7,162,822 | B1 | 1/2007 | Heayn et al. | |
| 7,398,616 | B1 | 7/2008 | Weir | |
| 7,478,495 | B1 * | 1/2009 | Alzamora et al. | 42/74 |
| 7,793,453 | B1 * | 9/2010 | Sewell et al. | 42/73 |
| 2007/0214697 | A1 * | 9/2007 | Ochoa | 42/73 |
| 2008/0110074 | A1 * | 5/2008 | Bucholtz et al. | 42/1.06 |

* cited by examiner

*Primary Examiner* — Stephen M Johnson
(74) *Attorney, Agent, or Firm* — MacCord Mason PLLC

(57) ABSTRACT

A stock assembly for attachment to a firearm assembly is described. The stock assembly includes a buttstock having a longitudinal conduit and a locking member; a connector tube with front and back ends slidable within the buttstock conduit between a fully inserted position and a fully extended position, the tube having a longitudinal conduit; an attachment member slidable within the tube conduit between a forward position and a rearward position, the attachment member having a front end attachable to the firearm assembly and a rear end; a spring within the connector tube engaging the rear end of the attachment member, the spring urging the attachment member toward its forward position; and locking means preventing rotation of the attachment member relative to the connector tube, while allowing the attachment member to move within the tube between its forward and rearward positions.

14 Claims, 11 Drawing Sheets

STOCK ASSEMBLY WITH RECOIL SUPPRESSION

This application is a continuation-in-part of U.S. patent application Ser. No. 12/455,125, filed May 28, 2009, now U.S. Pat. No. 8,051,593, issued Nov. 8, 2011, and also claims the priorities of U.S. Provisional Appl. Ser. No. 61/192,840 filed Sep. 22, 2008, and U.S. Provisional Appl. Ser. No. 61/203,894 filed Dec. 30, 2008, the entire disclosures of which are incorporated herein by reference.

BACKGROUND OF THE INVENTION (1) Field of the Invention

The present invention relates generally to stock assemblies for use with shoulder fired firearms, including shotguns and rifles, and in particular to a stock assembly to replace the original firearm stock having a means for recoil suppression.

(2) Description of the Prior Art

Firearms owners, in particular shotgun owners, often replace the original stock, or buttstock, with a replacement stock assembly to provide improved handling and control, or simply for aesthetic purposes: These replacement stock assemblies are normally comprised of a pistol grip, a buttstock, and a connector tube to join the buttstock to the pistol grip in designs where the pistol grip and buttstock are not integrally formed.

On shotguns, the pistol grip is adapted for attachment to the shotgun receiver in place of the conventional stock. While the pistol grip may be of different configurations, it will include a hand grip portion, a front face for attachment to the receiver, and a rear face for attachment to the intermediate connector tube. The pistol grip is normally attached to the receiver with a bolt inserted through the pistol grip and into the threaded bolt bore in the back of the receiver that was used to attach the original stock.

The buttstock most often used in replacement stock assemblies is known as a tactical stock or tactical buttstock and is designed to have the appearance of stocks used on combat weapons. A tactical buttstock may be of various configurations, but generally will include a conduit for slidably receiving the connector tube and a latching means to lock the connector tube in selected positions relative to the buttstock, thereby changing the length of the stock to meet the physical requirements and preferences of the user. The buttstock can also be in the configuration of a conventional shotgun stock, known as a sporter stock.

Generally, the front of the connector tube is inserted into a recess in the rear face of the pistol grip and a pin is inserted transversely through the pistol grip and tube to join the tube and pistol grip. The rear segment of the connector tube is slidable within the conduit in the buttstock between a fully inserted position and a fully extended position.

Means is provided for securing the connector tube at selected positions in the conduit between the fully inserted and extended positions, thereby changing the length of the stock assembly. For example, the connector tube may include a plurality of transverse holes or recesses longitudinally aligned along one side, with the buttstock including a retractable latching member, e.g., a pin or set screw, that is insertable into a selected hole to lock the tube and buttstock in the desired relationship.

While these replacement stock assemblies improve handling and aesthetics, prior art stock assemblies can break or detach at the connection of the connector tube to the pistol grip, and do not reduce recoil or "kick" when firing the shotgun, which is not only painful to the user, but also reduces accuracy in firing the shotgun. Therefore, there is a continuing need for a shotgun stock assembly that includes means for more durably attaching the assembly to the receiver and reducing recoil.

Replacement stocks are also useful for attachment to other shoulder-fired firearms, including rifles. As used herein, the term "firearms" is intended to encompass shoulder-fired firearms, in particular shotguns and rifles. The term "firearm assembly component" means a firearm receiver, pistol grip or a stock section, while "firearm assembly" means any combination of two or more of these components.

SUMMARY OF THE INVENTION

Generally, the present invention is directed to a stock assembly for use on a shoulder-fired firearm, such as a shotgun or rifle. While the stock can be original equipment, it will normally be sold as an after-market kit to be installed by the purchaser.

The major components of the stock assembly are a buttstock and a connector assembly for joining a firearm component. The connector assembly may also include a recoil suppressor. The pistol grip may be adapted for attachment to the firearm receiver in place of the conventional stock. While the pistol grip may be of different configurations, it will include a hand grip portion, a front face for attachment to the receiver, and a rear face for attachment to the connector assembly.

The buttstock may be of various configurations, but generally will include a means for attaching the connector assembly in selected positions relative to the buttstock, thereby changing the length of the stock to meet the physical requirements and preferences of the user. The buttstock can be in the configuration of a tactical buttstock or a sporter buttstock.

The connector assembly may be used only to connect the buttstock to the firearms assembly, or may serve this purpose and also act as a recoil suppressor depending on the components used in the connector assembly. When used without recoil suppression, the connector assembly is comprised of a connector tube and an attachment member to attach the stock to a firearms component.

In a preferred embodiment, the connector tube has a front end, a rear end, and an internal conduit having front and rear segments with a first given diameter and an intermediate segment with a second given diameter less than the first given diameter and shoulders at the interfaces of the intermediate section and the front and rear segments.

The connector tube may include a protective cover extending forward of the tube and partly over the attachment member when the attachment member is in the fully extended position and fully over exposed area of the attachment member and above a part of the pistol grip when the recoil suppressor is compressed, thereby preventing pinching of the user's cheek between the forward end of the tube and the pistol grip.

In one embodiment, a stop at the rear of the attachment member abuts the shoulder at the interface of the rear and intermediate conduit segments limiting forward movement of the attachment member within the conduit, while the shoulder at the interface of the front and intermediate segments abuts an enlarged segment of the attachment member to limit rearward movement of the attachment member into the tube. The forward end of the attachment member is attached to one of the firearm components, e.g., the pistol grip, the receiver, or a stock segment, depending on the firearm and the particular design of the buttstock.

In one embodiment, the pistol grip and attachment member are bolted together, the pistol grip is attached to the receiver by a second bolt that extends from the rear of the pistol grip into the threaded bore in the rear of the receiver used to attach the original stock. The axis of the threaded bore, and thereby the axis for the second bolt, is at an angle to the longitudinal axis of the tube and attachment member. Due to this angularity, it may be necessary to bevel the lower surface of the attachment member to provide a pathway for the receiver bolt.

When the recoil suppressor is not included in the connector assembly, the tube may be sized so that the forward end of the tube is tightly adjacent the pistol grip. When the assembly incorporates the recoil assembly, the attachment member is slidable in the conduit when the attachment member is secured to the pistol grip. When there is no recoil suppression incorporated into the assembly, but provision is made for later addition of recoil suppression, a spacer sleeve is positioned between the cap and shoulder, with the cap being tightened against the sleeve to hold the end of the tube against the pistol grip.

To add recoil suppression to the assembly, a compression spring is inserted into the tube conduit and a fixed rear spring retainer is inserted into the rear of the tube conduit to hold the spring against the rear of the attachment member. The length of the spring is such that the attachment member is fully extended and the connector tube is fully withdrawn from the pistol grip unless the spring is compressed. A rubber or other resilient insert can be positioned in the tube at one end of the compression spring.

Other means may be used to attach the attachment member to the pistol grip and the pistol grip to the retainer. In one alternative embodiment, a first rod threaded into the attachment member extends through a bore in the pistol grip to connect at a jointed connection to a second rod that is inserted into the threaded bore in the receiver. For example, the first and second threaded rods may be connected at their adjacent ends by a universal joint to create a connector assembly. The first rod extends forward from the attachment member to secure the connector assembly to the pistol grip while the second rod is threaded into the threaded receiver bore. Due to the universal joint, the combined attachment members can be inserted through the tube and pistol grip bore and rotated, e.g., by a long handled screwdriver, from within the tube.

In a second alternative embodiment, the attachment rods are joined at their adjacent ends with a ball and socket connector instead of a universal joint. In this configuration, the rear end of the receiver attachment rod terminates at a ball having a recess sized to receive a tool such as an Allen wrench. The ball end of the rod is pivotally mounted in a socket in the forward end of a cylindrical sleeve forming a part of the tube attachment member. An end cap is attachable to the sleeve, e.g., via a threaded connecting cylinder, to abut the tube shoulder and secure the tube to the pistol grip.

When using a connector assembly of this second alternative, the pistol grip is placed against the receiver and the connector assembly without the end cap is inserted through a bore in the pistol grip so that the forward threaded rod can be screwed into a bore in the receiver. The threaded rod is then tightened with an Allen wrench or other tightening tool. A collar around the rear of the threaded rod adjacent the ball limits insertion of the threaded rod.

The stock retainer cylinder is then fitted into the pistol grip and the end cap is attached to the rear of the assembly and tightened, e.g., with a long screwdriver inserted through the retainer cylinder. The end cap is tightened against a washer or other shoulder or component of the retainer to hold the retainer and pistol grip together.

Either of the above assemblies may include a guide to hold the pistol grip in alignment with the attachment member and the connector tube. The guide may be, for example, a recess in either the attachment member or pistol grip retainer recess and a corresponding projection in the other. Upon insertion of the attachment member into the recess in the pistol grip, the member is prevented from rotation by the projection. The guide component on the attachment member may also mate with a guide component in the tube conduit, or a separate guide may be provided between the tube and attachment member, thereby aligning the tube, attachment member and pistol grip.

An initially purchased stock assembly kit may include the buttstock, connector tube, attachment member, and compression spring. Depending on the design of the shotgun or rifle, a pistol grip may also be included in the kit. In addition, the kit may include a second stock having a configuration different from the configuration of the first stock. For example, a kit may include a tactical stock and a sporter stock. The sporter stock may include a conduit to receive the recoil suppressor cylinder and a locking member, e.g., a bolt or set screw, positioned for insertion into a selected hole in the cylinder.

When a firearm with the stock assembly is fired, the firearm assembly moves rearwardly, pressing the attachment member into the cylinder, and thereby compressing the spring which absorbs the force of the recoil. As a result, the impact of the rear of the stock, normally covered by a recoil pad, not shown, is substantially reduced. After firing, the spring decompresses to urge the retainer forward in preparation for the next shot. Positioning of the connector tube and pistol grip connector along an axis parallel to the longitudinal axis of the connector tube significantly strengthens the connection and reduces the risk of breakage due to the shotgun recoil.

Shoulder-fired firearms, e.g., shotguns and rifles, are manufactured in a great number of designs, requiring different means of connecting a replacement stock, in particular a stock with a recoil suppression means. The stock assembly, depending on the design, can be attached to the firearm receiver, the firearm pistol grip or a segment of the original stock, such as when the back of the original stock is cut off from the rest of the stock. Other means of attaching a replacement stock, in particular a replacement stock with a recoil mechanism, are described below.

In other embodiments of the invention, the stock assembly is comprised of a buttstock that includes a conduit for receiving a connector tube, a connector tube slidable to selected positions within the connector tube to shorten or lengthen the stock assembly, an attachment member having a front end attachable to a component of the firearm assembly, and a compression spring at the rear of the attachment member. The buttstock includes a locking member to secure the connector tube at selected locations within the buttstock conduit. A first restraining means is provided to prevent rearward movement of the spring, and a second restraining means is provided to prevent forward movement of the attachment member. The second restraining means also prevents rotation of the attachment member relative to the connector tube.

Attachment of the forward end of the attachment member to a firearm component can be achieved in various ways, includes the ways previously described. In addition, the attachment member can secured by inserting the forward end of the attachment member into a recess in the back of a firearm component, e.g., a part of the pistol grip, and inserting a removable fastener, e.g., a connector pin, transversely though a wall of the pistol grip and into the side of the attachment member.

Alternatively, the attachment means can be integrally formed with a firearm component, e.g., the pistol grip. The attachment means can also be secured to the firearm component by gluing, ultrasonic welding, etc., the only requirement being that the attachment means is secured to, and does not rotate relative to, the firearm component.

It is also necessary to prevent rotation of the attachment member relative to the connector tube, while allowing the attachment member to move backward under the force of the recoil and forward under the force of the compression spring. In certain of the embodiments described hereinafter, the rotation of the attachment member relative to the connector tube is prevented by inserting a pin transversely into the attachment member through a longitudinal slot in the connector tube.

The outer end of the pin projects into the slot to engage the tube wall at the front of the slot. A latching member, such as a bolt secures the pin in place. As the attachment member moves rearwardly under the force of the recoil, the outer end on the pin moves rearwardly within the slot. When the compression spring returns the attachment member to its original position, the outer end of the pin moves forward until it engages the front of the slot, preventing further forward movement of the attachment member relative to the connector tube.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
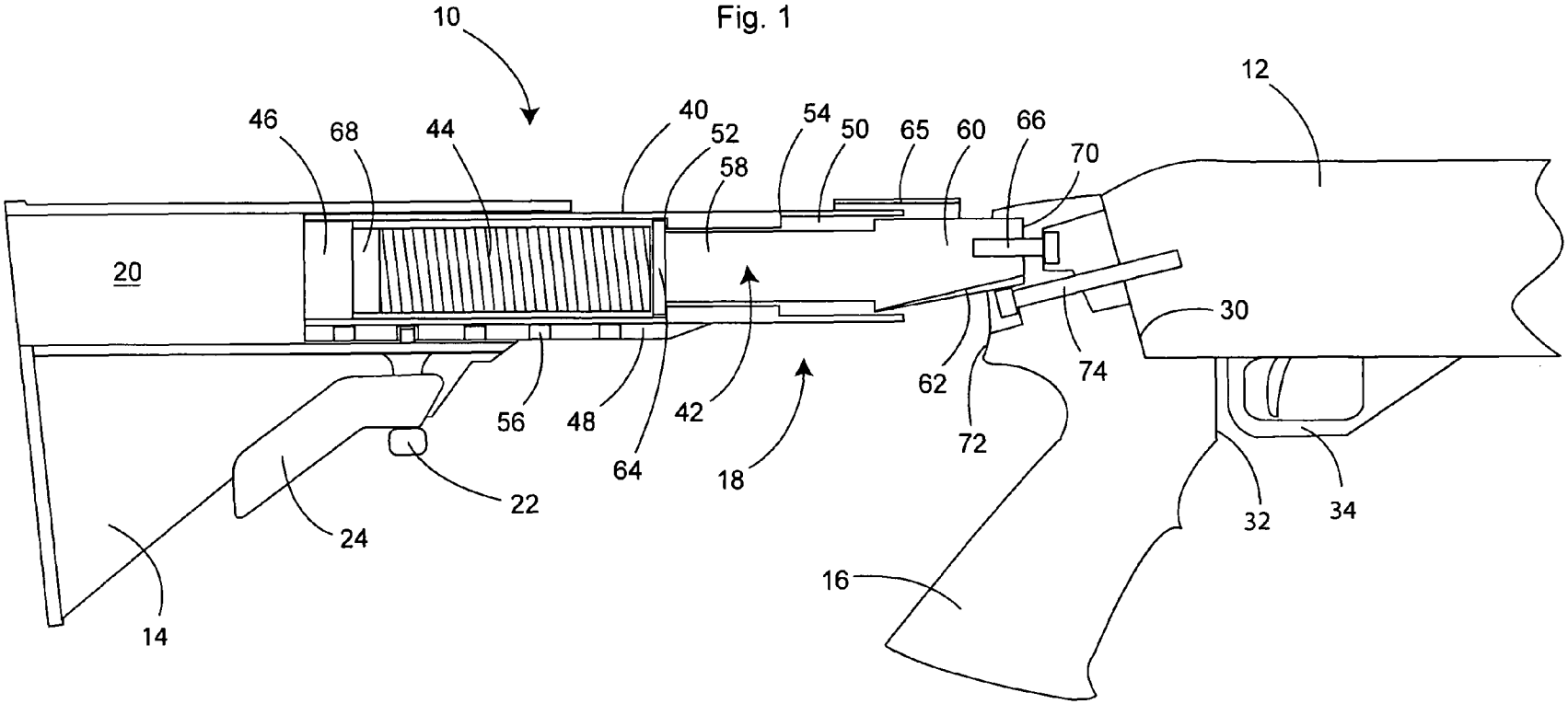
FIG. 1 is a partial sectional side view showing the components of the preferred stock assembly with recoil suppression.

FIG. 1 illustrates a sectional side view of a preferred embodiment of the stock assembly incorporating recoil suppression, generally 10, attached to shotgun receiver 12. The major components of stock assembly 10 are buttstock 14, pistol grip 16 and recoil connector assembly, generally 18.

Buttstock 14, which is preferably molded from an impact and scuff-resistant polymer, includes conduit 20 extending from the front to the rear of buttstock 14 to slidably receive connector assembly 18. Retractable latch pin 22 is mounted on buttstock 14 perpendicular to the longitudinal axis of conduit 20. Pin 22 is urged by a spring, not shown, to an extended position in which the tip of pin 22 extends into conduit 20, with pin 22 being at least partially withdrawn from conduit 20 when pin 22 is in the retracted position. Pin 22 is operably connected to handgrip 24 to move pin 22 from its extended position to its retracted position when handgrip 24 is gripped by the user.

Pistol grip 16, preferably also molded from an impact and scuff-resistant polymer, has a front attachment face 30 that is shaped to conform to the rear of receiver 12. A second face plate 32 is positioned behind trigger guard 34.

Recoil connector assembly 18 is comprised of connector tube 40, slidable within stock conduit 20 between a fully inserted position and a fully extended position, an attachment member 42, compression spring 44, and a rear spring retainer 46.

Connector tube 40 includes a longitudinally extending locking bar 42 integrally molded to the bottom of tube 40, and a tube conduit 50. Conduit 50 has a given diameter adjacent its rear and front ends, with an intermediate section having a smaller diameter and rear and forward shoulders 52 and 54. Preferably, tube 40 and bar 48 are also molded from an impact and scuff-resistant polymer. Bar 48 includes a Plurality of longitudinally spaced recesses 56 positioned to selectively receive the end of pin 22 when pin 22 is in its extended position, thereby selectively locking stock 14 to tube 40 to shorten or lengthen stock assembly 10 depending on the position selected.

Elongated attachment member 42 includes a rear end, a front end, a rear section 58 having a diameter corresponding to the diameter of the tube conduit intermediate section, and a front section 60 having a larger diameter corresponding to the diameter of the connector tube front section. Member 42 front section 60 is tapered upwardly with a concave taper 62 along its lower surface to permit attachment of pistol grip 16 to receiver 12 as will be described later in detail. A detachable end cap 64 having a diameter corresponding to the diameter of tube conduit rear section is attached to the rear of section 58. The front of attachment member 42 includes a threaded bore to receive pistol grip connector bolt 66.

Connector tube 40 includes a protective cover 65 extending forward of tube 40 and partly over attachment member 42 when attachment member 40 is in the fully extended position and fully over exposed area of attachment member 40 and above a part of pistol grip 16 when the recoil suppressor is compressed, thereby preventing pinching of the user's cheek between the forward end of tube 40 and pistol grip 16.

Rear spring retainer 46 is secured in a fixed position within the rear of tube conduit 50. Compression spring 44 is inserted within tube conduit 50 along the longitudinal axis of conduit 50 between attachment member 42 and spring retainer 46. When fully assembled, spring 44 abuts retainer 46 and the rear of attachment member 42, and is preferably, but not fully, compressed. If desired, an optional resilient, e.g., rubber, bumper 68 may be inserted between spring 44 and either retainer 46 or attachment member 42.

Attachment member 42 is secured to pistol grip 16 by inserting the front end of attachment member 42 into recess 70 in rear face 72 of pistol grip 16 and bolting attachment member 42 to pistol grip 16 with bolt 66 which extends rearwardly through pistol grip 16 into attachment member 42. Bolt 66 is aligned parallel to the longitudinal axis of connector tube 40 to strengthen the connection.

Pistol grip 16 is secured to receiver 12 by bolt 74, which extends upwardly at an angle relative to bolt 66 from the rear of pistol grip 16 to the front of pistol grip 16 and into a threaded bore in receiver 12 used to attach the original stock. Due to the dimensions of the components, bevel 62 is required to permit alignment of bolt 74. Bolts 66 and 74 are aligned in a vertical plane.

When the shotgun is fired, the shotgun and pistol grip 16 move rearwardly, pressing attachment member 60 into tube 40, compressing spring 44 to absorb the force of the recoil. As a result, the impact against the user's shoulder of the rear of stock 14, normally covered by a recoil pad, not shown, is substantially reduced. After firing, spring 44 urges member 60 forward to its fully extended position in preparation for the next shot.

Figure 2:
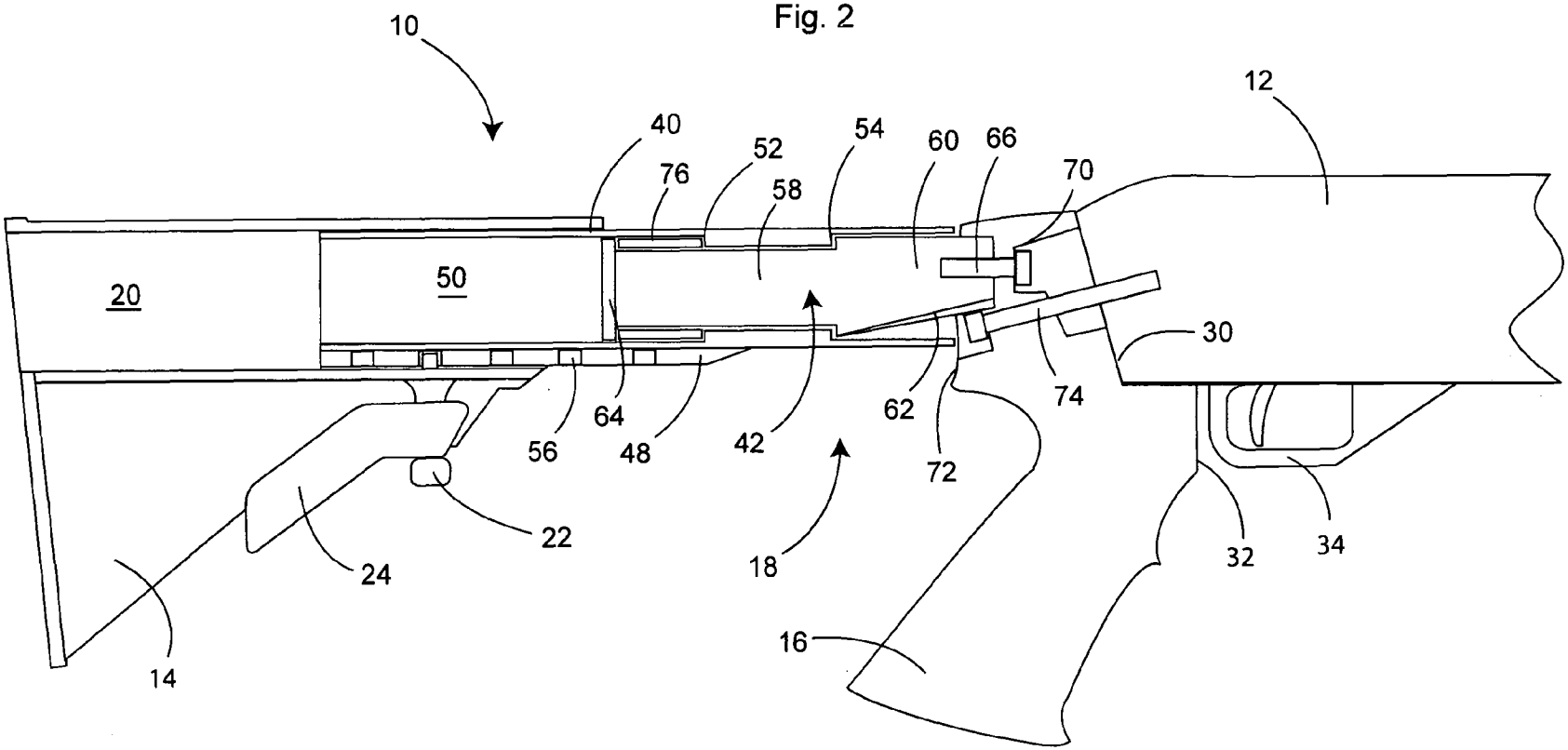
FIG. 2 is a partial sectional side view showing the components of the preferred stock assembly without recoil suppression.

FIG. 2 illustrates the above embodiment without the recoil feature, without recoil spring 44 and rear spring retainer 46. Instead, attachment member 42 is fully inserted into tube conduit 50 and cylindrical spacer 76 is positioned around attachment member section 58 before attachment of cap 64. Due to spacer 76, connector tube 40 is positioned against the rear of pistol grip 16. If it is later desired to add recoil suppression to the assembly, spacer 76 is simply replaced by spring 44 and rear spring retainer 46.

Figure 3:
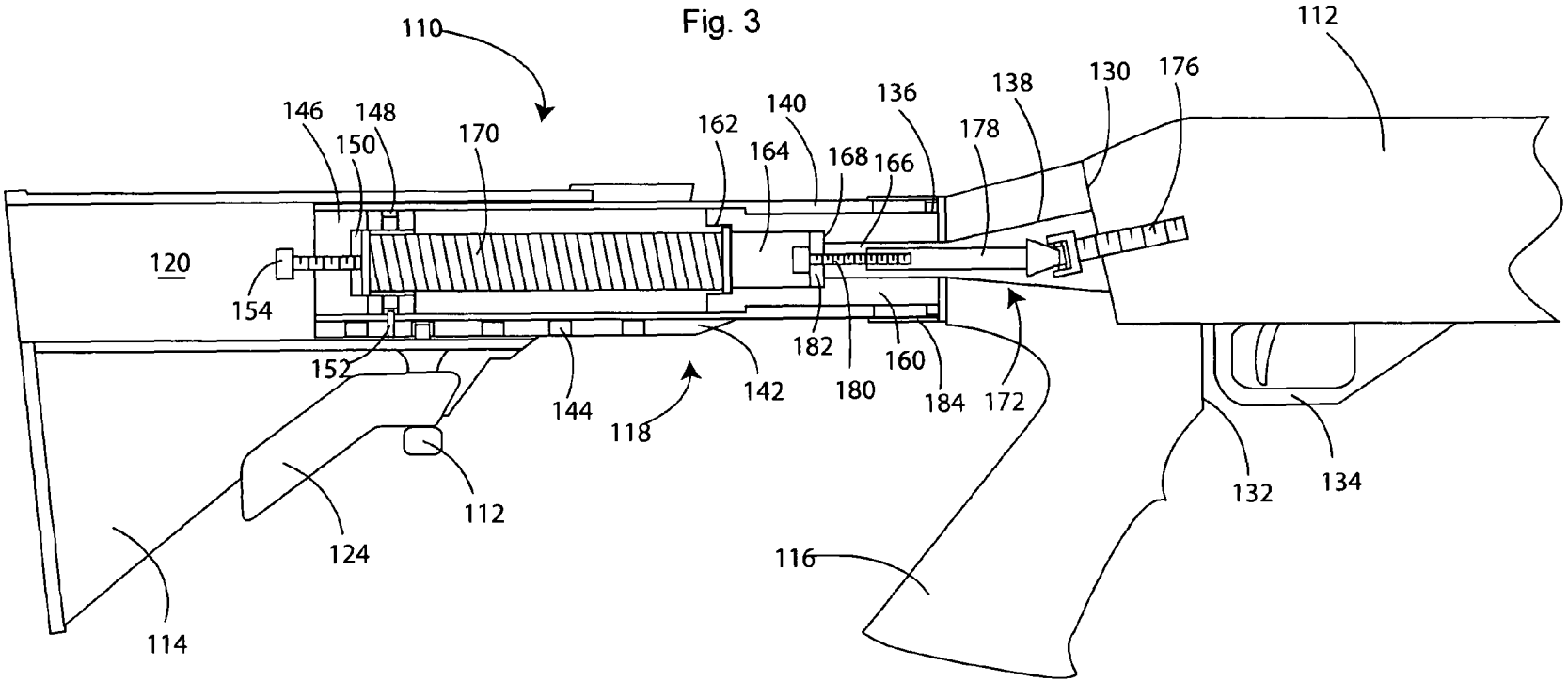
FIG. 3 is a partial sectional side view showing the interior components of an alternative embodiment of the stock assembly.
Figure 4:
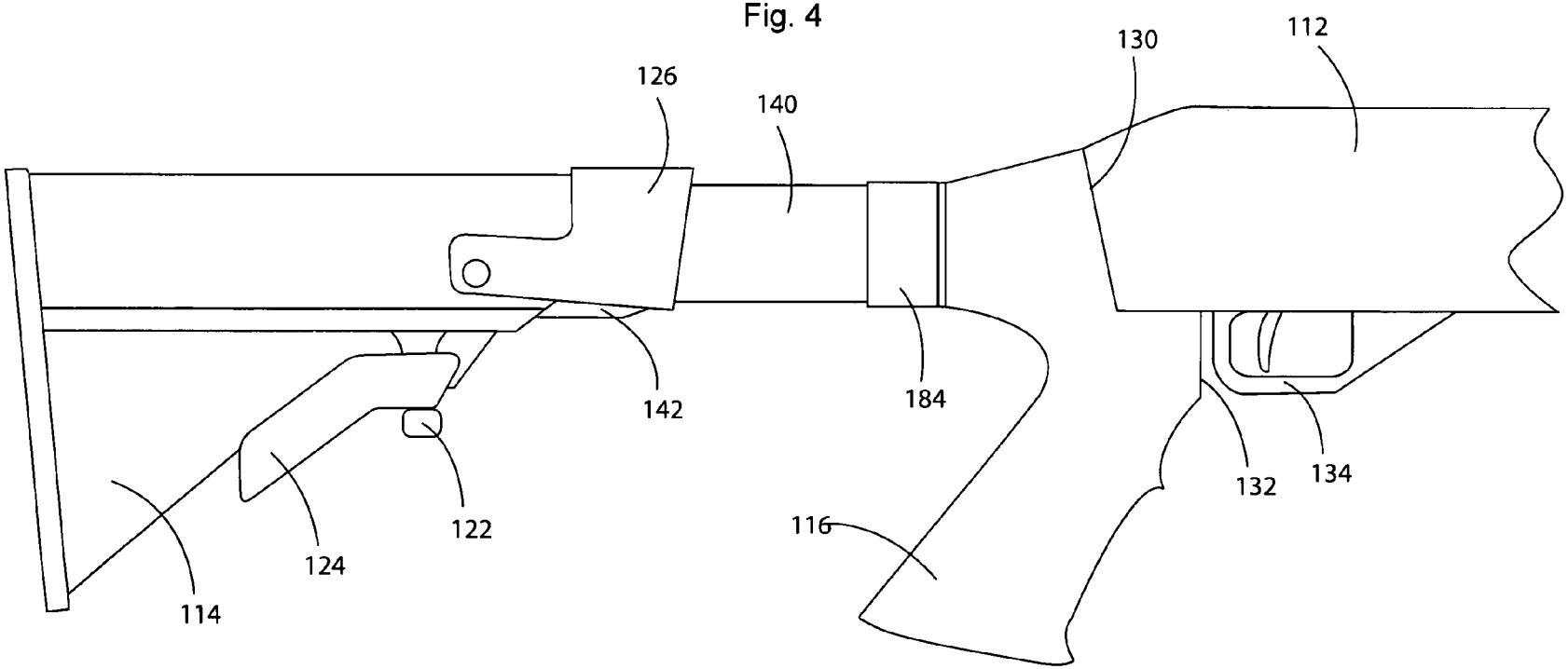
FIG. 4 is a side view of the stock of FIG. 3.

As illustrated in FIGS. 3-4, an alternative embodiment of the tactical stock, generally 110, is shown attached to shotgun receiver 112. The major components of stock 110 are buttstock 114, pistol grip 16 and recoil mechanism, generally 118.

Buttstock 114, which is preferably molded from an impact and scuff-resistant polymer, includes conduit 120 extending from the front to the rear of buttstock 114 to slidably receive recoil mechanism 118. Retractable latch pin 122 is mounted on buttstock 114 perpendicular to the longitudinal axis of conduit 120. Pin 122 is urged by a spring, not shown, to an extended position in which the tip of pin 122 extends into conduit 120, with pin 122 being at least partially withdrawn from conduit 120 when pin 122 is in the retracted position. Pin 122 is operably connected to handgrip 124 to move pin 122 from its extended position to its retracted position when handgrip 124 is gripped by the user. Stock 110 can also include a pivotal cover 126 extending over the forward end of conduit 120.

Pistol grip 116, preferably also molded from an impact and scuff-resistant polymer, has a front attachment face 130 that is shaped to conform to the rear of receiver 112. A second face plate 132 is positioned behind trigger guard 134. The rear of pistol grip 116 includes retainer recess 136. Pistol grip 116 also includes connector conduit 138 extending from face 130 to recess 136.

Recoil mechanism 118 is comprised of cylinder 140, which includes a rear section slidable inside conduit 120 and a front section extending forward of buttstock 114. Longitudinally extending locking bar 142 is integrally molded to the bottom of cylinder 140. Preferably, cylinder 140 and bar 142 are also molded from an impact and scuff-resistant polymer. Bar 142 includes a plurality of longitudinally spaced recesses 144 positioned to selectively receive the end of pin 122 when pin 122 is in its extended position, thereby shortening or lengthening the tactical stock depending on the position selected.

Rear spring retainer 146 is secured in a fixed position within the rear of cylinder 140. Retainer 146 includes an annular groove 148 and an axial spring-receiving recess 50 extending inwardly from the front of retainer 146. Retainer 146 is held in its fixed position in the rear of cylinder 140 by a set screw 152 that extends through the wall of cylinder 140 into groove 148. Retainer 146 also includes a spring compression adjustment screw 154 that extends from the rear of retainer 146 into the base of bore 150. Rotation of screw 154 controls the extent of projection of screw 154 into bore 150, and thereby the compression of the spring and resulting resistance to recoil.

Attachment member 160 is slidably positioned within, and extends from the front of, cylinder 140. Forward movement of member 160 is limited by abutment against an annular shoulder on the inner wall of cylinder 140. Member 160 includes an axial spring recess 162 in its inner face, an intermediate bore 164 extending forward from recess 162, and a connection bore 166 extending from the forward end of bore 162 to the front of member 160. Bore 166 is of a smaller diameter than bore 164, creating a shoulder 168 at the interface of the bores.

Compression spring 170 extends along the longitudinal axis of cylinder 140 between retainer 146 and member 160. The rear end on spring 170 fits within recess 150 of retainer 146 and the front end of spring 170 fits within recess 162 of member 160. When fully assembled, retainer 146 and member 160 hold spring 170 in a partially, but not fully, compressed state.

Stock 110 is secured to shotgun receiver 112 by a first type of connection assembly, generally 172. As shown in this connector embodiment, assembly 172 is comprised of a universal joint connector 174 having a front section 176 screw fitted into the bore in receiver 112 used to attach the original stock, and a rear section 178 extending rearwardly through conduit 138 of pistol grip 116 into front bore 164 of member 160.

Connector bolt 180 with washer 82 abuts against shoulder 168 at the interface of the bores with the shaft of bolt 180 being threaded into an axial bore in the end of section 178 of assembly 170. Tightening of bolt 180 seats the forward end of member 160 into recess 136 of pistol grip 116 and secures face 130 of pistol grip 116 against receiver 112. Annular sleeve 184 fits over the space between cylinder 140 and pistol grip 116, And over the forward end of member 160 to prevent pinching of the user's cheek.

Figure 5:
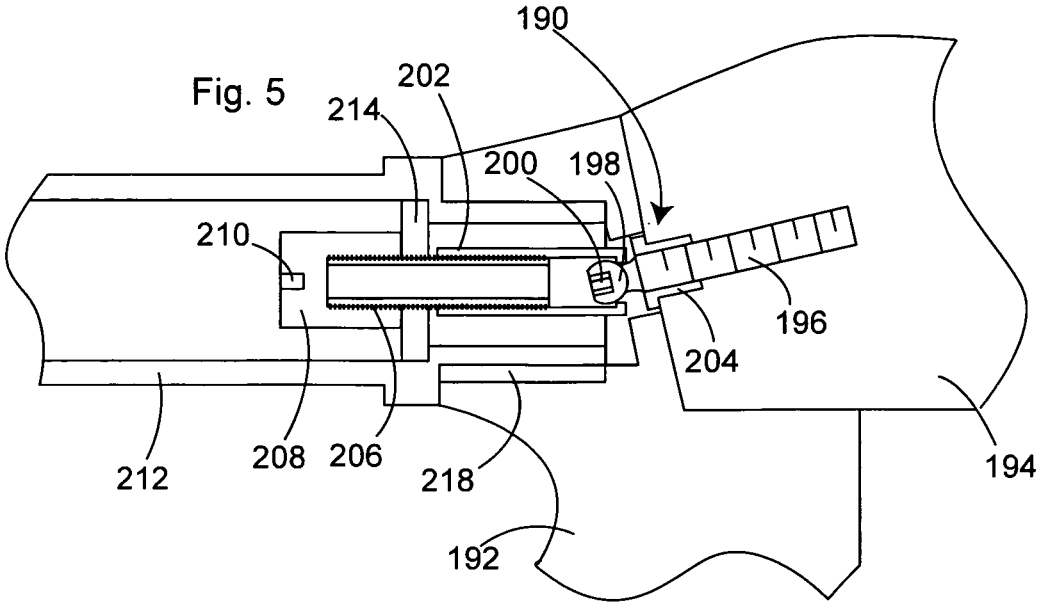
FIG. 5 is a partial sectional side view of the stock showing the interior components with an alternative connector embodiment with sections cut away to show joinder of the components.
Figure 6:
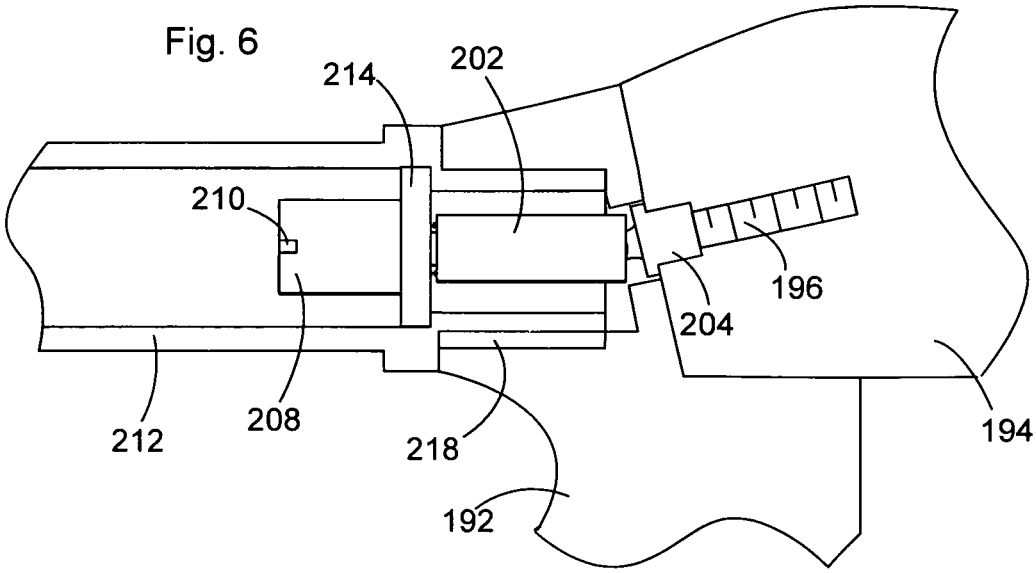
FIG. 6 is a partial sectional side view of the stock showing the interior components with an alternative connector embodiment.

FIGS. 5-6 illustrate another connector assembly, generally 190, to secure pistol grip 192 to shotgun receiver 194. Assembly 190 includes a threaded rod 196 which is threaded into a bore in receiver 194. The rear end of rod 196 terminates in a ball 198 with a hexagonal recess 200 sized to receive the end of an Allen wrench. Ball 198 is pivotally mounted in a socket in the forward end of cylindrical sleeve 202, which includes an inward flange at its forward end to form a socket to receive ball 198. Collar 204 limits the insertion of rod 196.

Sleeve 202 is internally threaded, except for the socket portion, and is sized to receive externally threaded cylinder 206 which is threaded into the rear of sleeve 202 up to the socket. The internal bore of cylinder 206 is large enough to permit insertion of an Allen wrench through cylinder 206 and sleeve 202 into recess 200 in ball 198, enabling tightening of rod 196 with an Allen wrench. End cap 208 is threadable onto the rear end of cylinder 206 and is rotatable with a screw driver fitted into slot 210.

To attach pistol grip 192 to receiver 194 using assembly 172, Rod 196 with collar 204, sleeve 202 and cylinder 206 attached is inserted through a bore in pistol grip 192 into the bore in receiver 192. Rod 196 is then rotated by inserting an Allen wrench into recess 200 in ball 198. Collar 204 limits insertion of the threaded rod by abutting against pistol grip 192 when rod 196 is fully inserted.

Stock retainer 212 is then fitted onto pistol grip 192 and end cap 208 is attached to the rear of the assembly and tightened, e.g., with a long screwdriver inserted through retainer 212. End cap 208 is tightened against washer 214 to hold retainer 212 and pistol grip 192 together. Retainer 212 is also secured to pistol grip 192 with attachment screw 216 and an identical screw on the opposite side of pistol grip 192. Rotation of retainer 212 relative to pistol grip 192 is prevented by guide 218 slidable within a guide channel in pistol grip 192.

Figure 7:
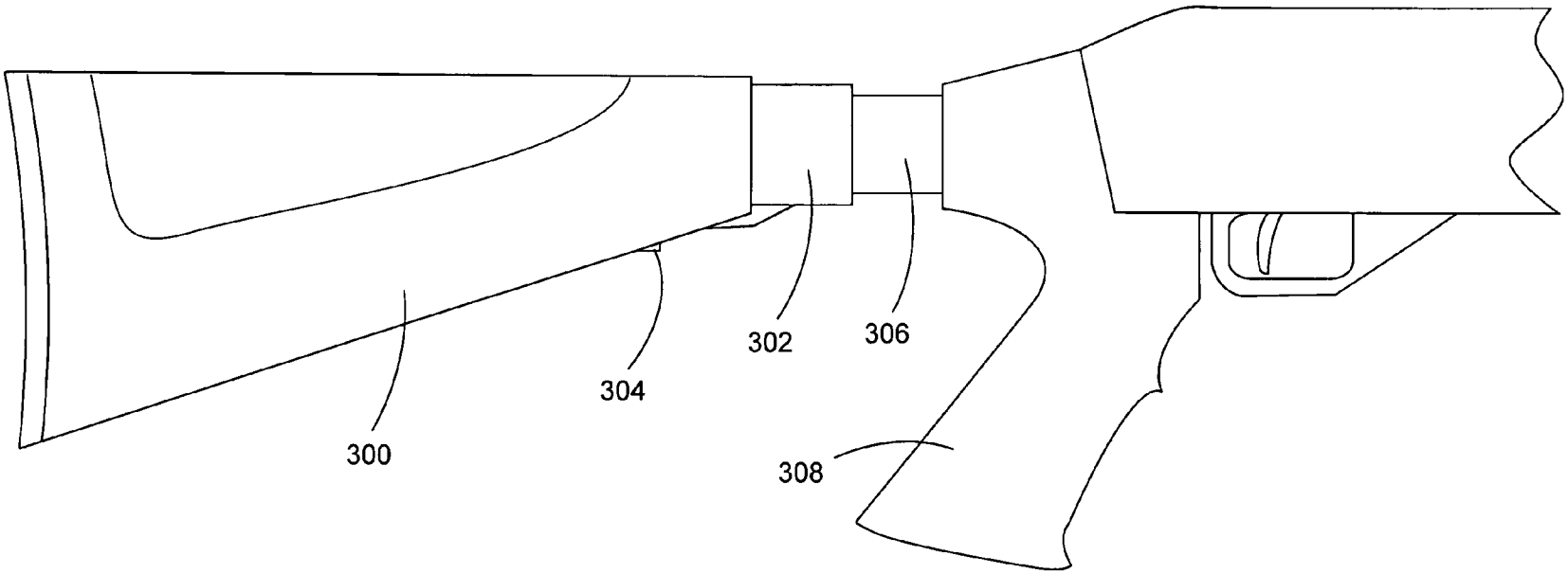
FIG. 7 is a side view of a shotgun with an alternative stock forming part of the stock assembly.

FIG. 7 illustrates a shotgun with a differently shaped stock 300, in this instance a sporter stock. Connector tube 302 is slidable to selected positions into stock 300 and lock in place with set screw 304. An attachment member 306 attaches tube 302 to pistol grip 308. It will be understood that stocks of other shapes can also be used.

Figure 8:
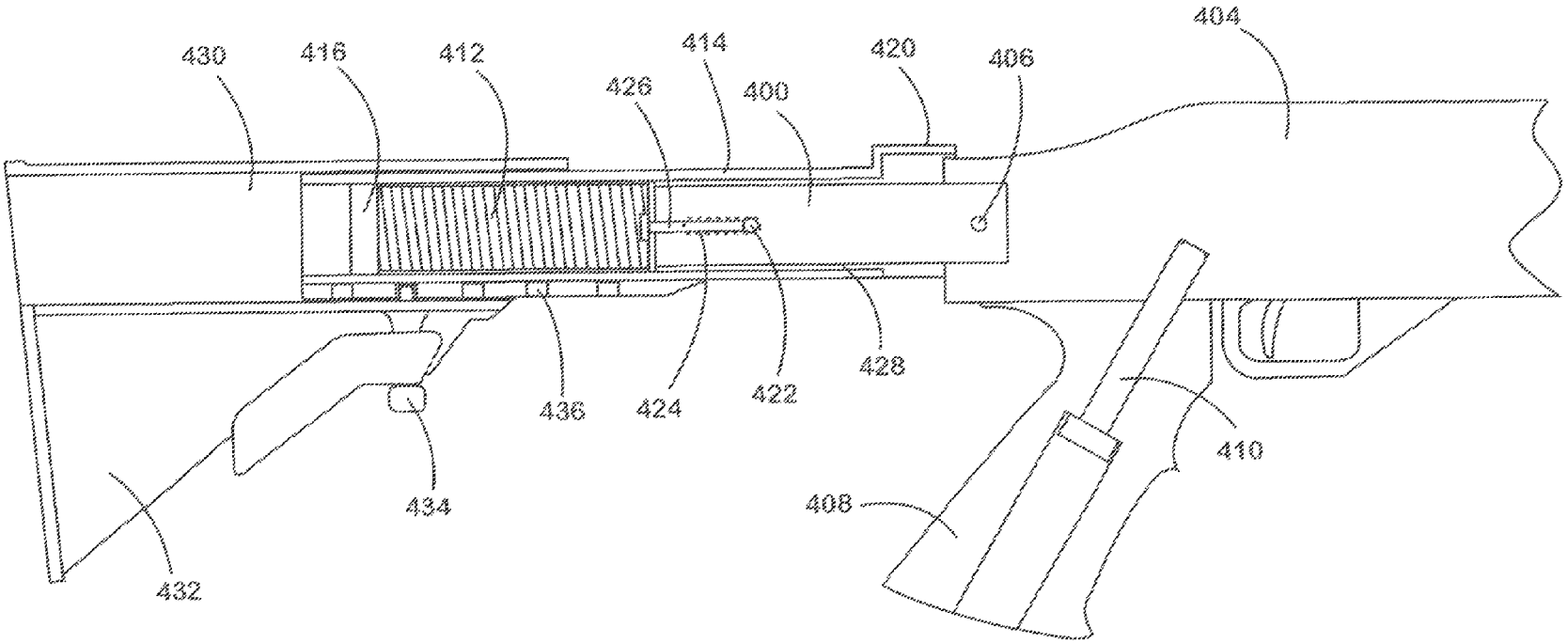
FIG. 8 is a side view of a firearm with an alternative stock forming part of the stock assembly.

FIG. 8 illustrates another embodiment of the invention in which attachment member 400 is inserted into a recess 402 in the rear of receiver 404 and attached with transverse pin 406. Pin 406 prevents rotation of member 400 relative to receiver 404. Pistol grip 408 is bolted to receiver 404 with bolt 410, which extends upwardly through pistol grip 408.

The rear to attachment member 400 abuts the front of compression spring 412, which is prevented from moving rearwardly in connector tube 414 by plug 416. Connector tube 414 includes an enlarged shield 420 at its forward end to cover the forward end of attachment member 400 where it connects to receiver 404, preventing pinching of the user's fingers or cheek.

Figure 9:
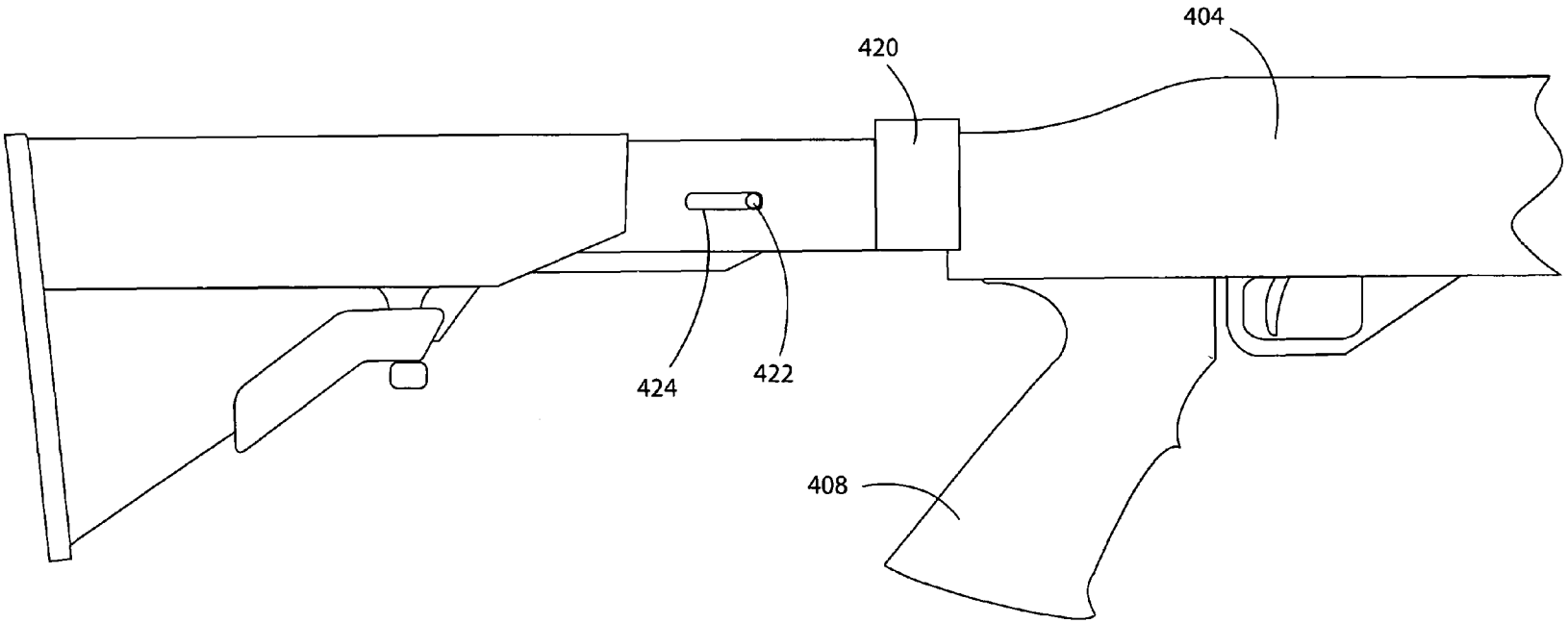
FIG. 9 is a side view of the firearm of FIG. 8.

As illustrated in FIGS. 8 and 9, attachment member 400 is prevented from rotating relative to connector tube 414 by transverse pin 422, which is inserted through longitudinally aligned slot 424 in connector tube 414. Pin 422 is held in place by bolt 426, which has its distal end tightened against pin 422. Attachment member 400 is slidable within attachment member conduit 428 between forward and rearward positions. Connector tube 414 is slidable within connector tube conduit 430 in buttstock 432. Buttstock 430 includes a retractable latching pin 434 selectively insertable in to one of a plurality of longitudinally spaced recesses 436 to secure connector tube 414 to buttstock 430.

When the firearm, which may be a shotgun or rifle, is fired, receiver 404 moves rearwardly under the recoil force, urging attachment member 400, rearwardly to compress spring 412. Pin 422 slides rearwardly in slot 424. Spring 412, compressed by the rearward movement of attachment member 400, then returns to its uncompressed state, moving attachment member 400 forward, with pin 422 sliding forward in slot 424 until pin 424 engages the front end of slot 424.

Figure 10:
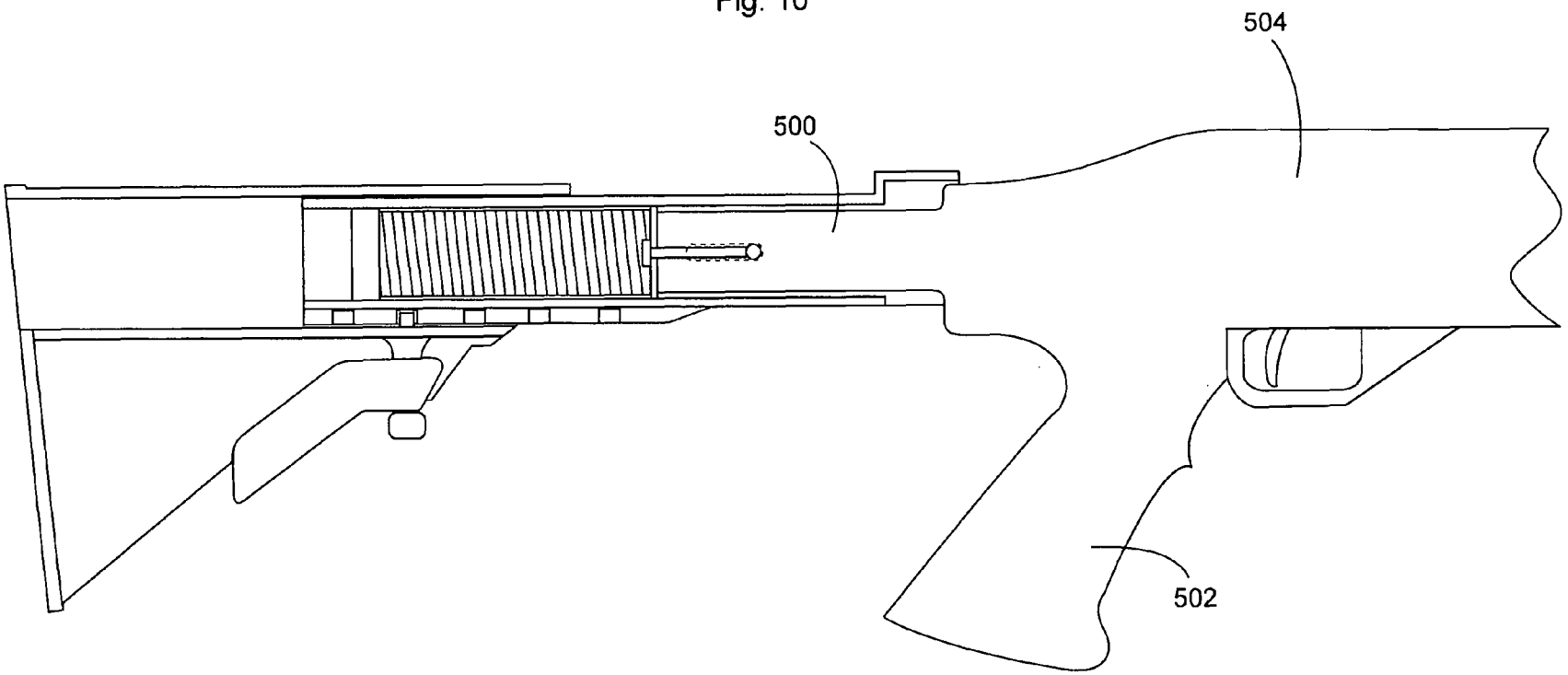
FIG. 10 is a partial sectional side view showing the interior components of yet another stock assembly attached to another firearm component.

FIG. 10 illustrates an embodiment of the invention in which attachment member 500 is integrally formed with pistol grip 502, shown attached to receiver 504. For example, member 500 and pistol grip 502 may be molded of engineering plastic as a single unit.

Figure 11:
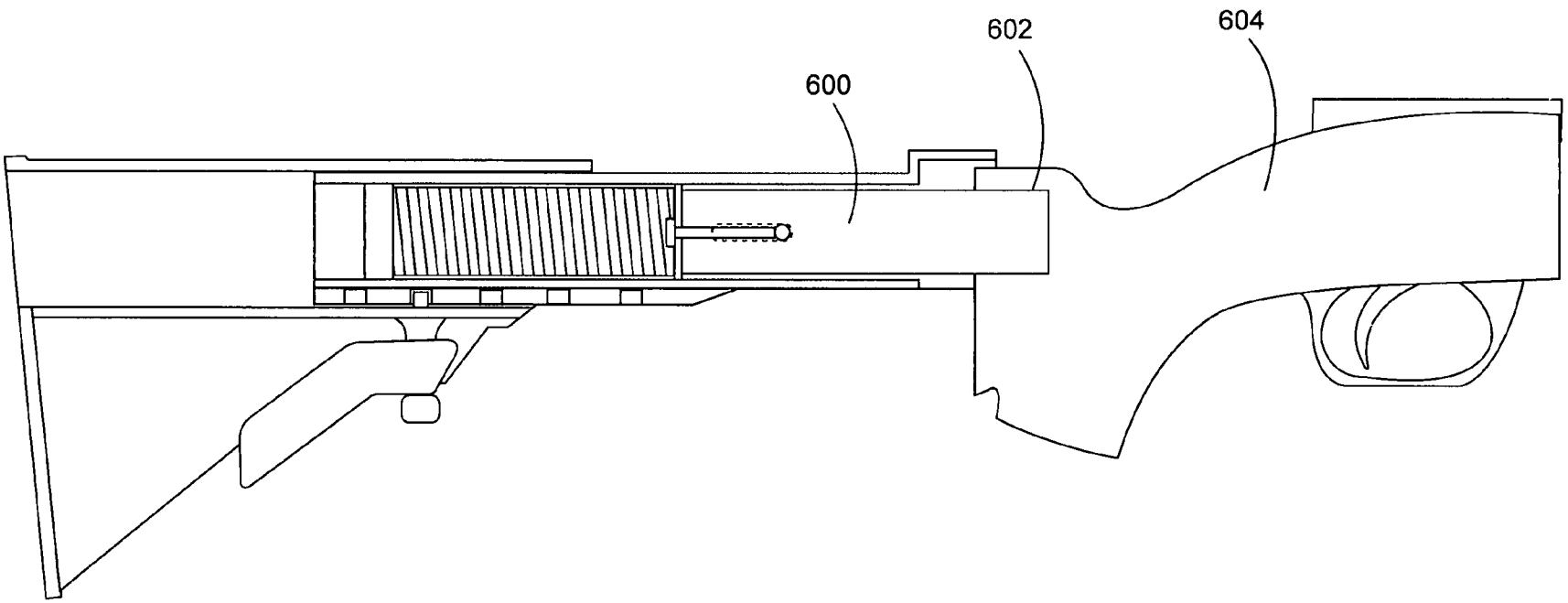
FIG. 11 is a partial sectional side view showing the interior components of still another stock assembly attached on another firearm component.

FIG. 11 illustrates an embodiment of the invention in which the forward end of attachment member 600 is adhesively bonded in recess 602 bored into the rear face of cut-off stock segment 604.

Figure 12:
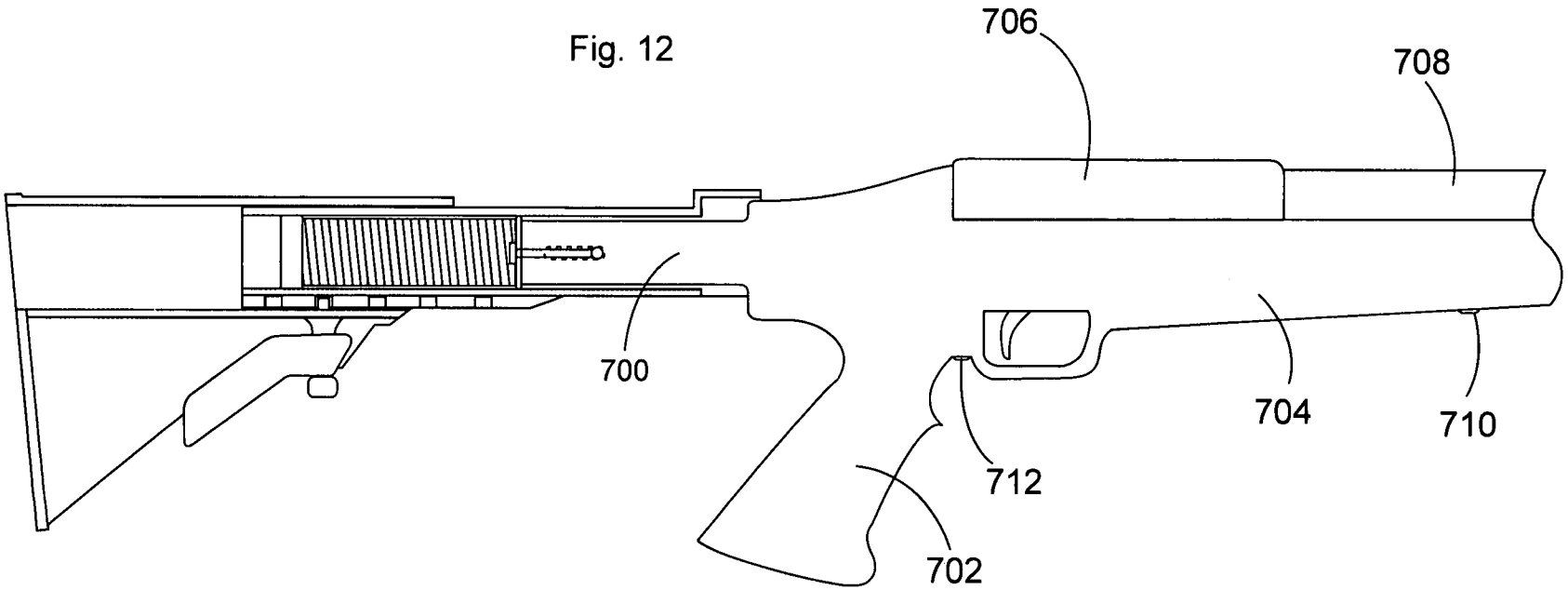
FIG. 12 is a side view of another stock assembly in which the attachment member, pistol grip and stock are integrally formed.

FIG. 12 illustrates an embodiment of the invention in which attachment member 700 is integrally formed, such as by molding, with pistol grip 702 and stock forend 704. Rifle receiver 706 and barrel 708 are designed to drop into a recess in the top of forend 704 with connectors 710 and 712 securing receiver 706 and barrel 708 to pistol grip 702 and forend 704.

With the exception of the manners in which the attachment member is attached to the firearm component, e.g., the receiver, a stock segment or pistol grip, the stock assembly components are the same as described with respect to the embodiment of FIGS. 8 and 9 and function in the same manner.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A replacement stock assembly for attachment to a component of a firearm assembly comprising:

a) a buttstock having a connector tube conduit;

b) a connector tube slidable within said connector tube conduit, said connector tube having an attachment member conduit;

c) an attachment member slidable within said attachment member conduit, said attachment member having a front end attachable to said firearm assembly component, and a rear end;

d) a spring within said attachment member conduit urging said attachment member forward; and e) a locking member preventing rotation of said attachment member relative to said connector tube while allowing said attachment member to move longitudinally within said attachment member conduit.

2. The replacement stock assembly of claim 1, wherein said component is a pistol grip.

3. The replacement stock assembly of claim 1, wherein said component is a receiver.

4. The replacement stock assembly of claim 1, wherein said attachment member is attached to said component with a transverse pin.

5. The replacement stock assembly of claim 1, wherein said connector tube includes a wall with a longitudinal slot, and said locking member is a pin extending transversely through said slot and into said attachment member.

6. The replacement stock assembly of claim 5, wherein said longitudinal slot has a front end, said pin engaging said slot front end to prevent forward movement of said attachment member.

7. The replacement stock assembly of claim 5, further including a bolt to secure said pin to said attachment member.

8. The replacement stock assembly of claim 1, wherein said buttstock includes a retractable latch pin, and said connector tube includes a plurality of spaced latch pin recesses, said latch pin being selectively insertable into said latch pin recesses to lock said connector tube relative to said buttstock.

9. A replacement stock assembly for attachment to a component of a firearm assembly comprising:

a) a buttstock having a connector tube conduit;

b) a connector tube slidable within said connector tube conduit, said connector tube having an attachment member conduit and a wall with a longitudinal slot;

c) an attachment member slidable within said attachment member conduit between forward and rearward positions, said attachment member having a front end attachable to said firearm assembly component, and a rear end;

d) a spring within said attachment member conduit urging said attachment member forward; and e) a pin extending transversely through said longitudinal slot and into said attachment member preventing rotation of said attachment member relative to said connector tube while allowing said attachment member to move longitudinally within said attachment member conduit.

10. The replacement stock assembly of claim 9, wherein said longitudinal slot has a front end, said pin engaging said slot front end to prevent forward movement of said attachment member.

11. The replacement stock assembly of claim 9, further including a bolt to secure said pin to said attachment member.

12. The replacement stock assembly of claim 9, wherein said component is a pistol grip.

13. The replacement stock assembly of claim 9, wherein said component is a receiver.

14. The replacement stock assembly of claim 9, wherein said buttstock includes a retractable latch pin, and said connector tube includes a plurality of spaced latch pin recesses, said latch pin being selectively insertable into said latch pin recesses to lock said connector tube relative to said buttstock.

* * * * *